United States Patent [19]

Hicks et al.

[11] Patent Number: 4,521,303

[45] Date of Patent: Jun. 4, 1985

[54] SOLIDS SEPARATION IN A SELF-CIRCULATING MAGNETICALLY STABILIZED FLUIDIZED BED

[75] Inventors: Alfonza Hicks, Trenton; Jerry E. Hankins, Orange, both of N.J.

[73] Assignee: Exxon Research & Engineering Co., Florham Park, N.J.

[21] Appl. No.: 607,409

[22] Filed: May 7, 1984

Related U.S. Application Data

[63] Continuation of Ser. No. 345,048, Feb. 2, 1982.

[51] Int. Cl.[3] ..... B03B 5/28

[52] U.S. Cl. ..... 209/454; 209/474; 209/172.5; 209/478; 422/139; 422/147; 34/1

[58] Field of Search ..... 209/454, 466, 467, 474, 209/172.5, 173, 172, 478, 39, 212, 213, 40, 1; 34/10, 1; 165/104.16; 201/31; 422/139, 147, 143–145; 423/DIG. 16; 425/DIG. 20; 427/185, 213

[56] References Cited

U.S. PATENT DOCUMENTS

| | | | |
|---|---|---|---|
| 1,291,137 | 1/1919 | Reed | 209/474 |
| 3,444,996 | 5/1969 | Douglas et al. | 209/467 |
| 3,774,759 | 11/1973 | Weintraub et al. | 209/474 |
| 4,115,927 | 9/1978 | Rosensweig | 34/1 |
| 4,132,005 | 1/1979 | Coulaloglou | 34/10 |
| 4,322,287 | 3/1982 | Zaltzman et al. | 209/44 |

FOREIGN PATENT DOCUMENTS

| | | | |
|---|---|---|---|
| 449085 | 6/1979 | United Kingdom | 209/172.5 |

*Primary Examiner*—Frank W. Lutter
*Assistant Examiner*—William Bond
*Attorney, Agent, or Firm*—John W. Ditsler; E. Thomas Wheelock

[57] ABSTRACT

A mixture comprising non-magnetic solids is separated according to the density difference of its components by contact with a separating medium comprised of a fluidized bed of magnetizable particles which is stabilized by a magnetic means. The separating medium circulates in a closed loop within a contacting vessel or zone such that at least two portions of said separating medium flow in essentially opposite directions transverse to the flow of the fluidizing fluid exiting the medium. This invention is particularly effective for separating mixtures of coal or for separating coal from other solids.

12 Claims, 4 Drawing Figures

SOLIDS SEPARATION IN A SELF-CIRCULATING MAGNETICALLY STABILIZED FLUIDIZED BED

This is a continuation of application Ser. No. 345,048 filed Feb. 2, 1982.

BACKGROUND OF THE INVENTION

1. Field of the Invention

The present invention relates to a method for effecting solids separation in a magnetically stabilized fluidized bed. More specifically, the invention concerns separating a mixture comprising non-magnetic solids according to the difference in density of said solids using a self-circulating magnetically stabilized fluidized bed.

2. Discussion of Patent and Publication Disclosures

Many devices such as vibrating screens, fluidized bed classifiers, magnetic separators and the like have been suggested for separating mixtures of solids by density. See R. H. Perry and C. H. Chilton, *Chemical Engineers' Handbook,* 5th ed., Sections 7 and 21, McGraw Hill, Inc. (1973). In general, such separating devices can be characterized as magnetic or non-magnetic classifiers. Of the non-magnetic classifiers, fluidized bed type classifiers are relevant to the present invention See, for example, Barari et al., *Indian Journal of Technology,* 16 pp. 343–6 (1978); G. F. Everson, *Coal Preparation,* July/August, pp. 135–139 (1966) and U.S. Pat. Nos. 3,261,293, 3,288,282, 3,333,692, 3,349,912; Douglas et al., *A.I.Ch.E. Symp. Ser.* 67 (116), pp. 201–9 (1971); Weintraub et al., U.S. Pat. No. 3,774,759; Japan Tokyo Koho No. 80/05,376 and Reed, U.S. Pat. No. 1,291,137, the entire disclosures of each being incorporated herein by reference. Magnetic classifiers such as those used for ore beneficiation which separate magnetic from non-magnetic materials are also of interest See for example, U.S. Pat. Nos. 4,219,408; 4,225,426 and 4,239,619, the entire disclosures of each being incorporated herein by reference. It has also been disclosed that "When a suspended material, like particles of magnetite in a device for dry carbon enrichment in a heavy medium for instance, has ferromagnetic properties a magnetic field can also be used to regulate the process. No less interesting is the possibility of the magnetic separation of ferromagnetic particles, . . . " See Filippov, *Prikladnaya Magnitogidrodinamika,* Latviiskoi SSR 12:215–236 (1969). However, no mention is made of separating materials of different density in a quiescent magnetized stabilized fluidized bed through which said materials could flow.

A typical continuous fluidized bed separation device includes a trough or sluice containing a gaseous fluidized bed as the separating medium, see Douglas et al., *A.I.Ch.E. Symp. Ser.* 67 (116), p. 201 (1971). The mixture to be separated is introduced into the fluidized bed and separated into several products according to the density of the components of said mixture. However, such devices cannot be operated at high fluidization velocities due to bubbling and concomitant feed solids stirring in gas fluidized beds and solids backmixing in liquid fluidized beds due to random mixing motions in said bed which adversely affect the effectiveness (i.e. sharpness) of the separation. Restricting the velocity of the fluidizing fluid to reduce or prevent bubble formation and solids backmixing limits the operation of the above devices to a narrow range of densities. Thus, while a conventional fluidized bed separation devices can separate in a single density range, a single device cannot be easily adapted to operate in a number of ranges.

In addition, the heavier (i.e. more dense) solids in the feed mixture are often difficult to remove after having settled to the bottom of conventional fluidized bed separators. As such, cumbersome conveyor belts, scrapers and chain devices have been employed to overcome this problem. Similarly, the mixture to be separated can become trapped in a fluidized bed such that various separation enhancing devices (e.g., vibrating, oscillating and pulsating devices) are often employed to complete the separation, see Douglas et al., *A.I.Ch.E. Symp, Series,* 67 (116), p. 210 (1976). One suggestion for overcoming such difficulties involves creating a circulatory motion within the bed using a chain with paddles, see U.S. Pat. No. 4,194,971.

Traditionally, fluidized bed magnetic separators have been used to separate magnetizable particles from non-magnetizable particles, with specific application to ore beneficiation. A typical example is a process wherein a fluidized mixture of magnetizable and non-magnetizable particles is introduced into a vessel in which the mixture is subjected to an external magnetic field which attracts the magnetizable particles toward the vessel's perimeter, leaving the non-magnetizable particles in the central zone of the vessel. See U.S. Pat. No. 4,239,619. However, the present invention does not involve the separation of magnetizable from non-magnetizable particles.

More recently, Shubert, U.S. Pat. Nos. 3,926,789 and Re. 30, 360, has disclosed a proess for mineral beneficiation to recover mineral concentrate from ore wherein particulate mixtures of non-magnetic or paramagnetic materials are separated from the ore by selectively coating the components of the mixture with a magnetic fluid. The particulate mixture is then separated by magnetic attraction into a magnetic fluid coated fraction and a non-magnetic fraction. In addition, U.S. Pat. No. 4,238,323 the entire disclosure of which is incorporated hereby by reference, discloses the use of magnetically induced eddy currents in electrically conducting particles to separate non-magnetic free-flowing particles. However, these approaches differ from that disclosed in the present invention.

In U.S. Pat. No. 3,483,964, the entire disclosure of which is incorporated herein by reference, R. E. Rosensweig discloses a process for separating a non-magnetic mixture of particles by density using the principle of levitation in a ferromagnetic liquid. As disclosed therein, a lower density portion of the mixture to be separated is floated by the interaction of a gradient magnetic field and the ferrofluid while another portion of the mixture having a greater density sinks through the ferrofluid. This process, however, is not suitable when the mixture cannot be subjected to a wetting ferrofluid; i.e., when a dry separation is desired. In addition, wetting and concomitant removal and recovery and/or loss of ferrofluid is costly due to the expense of adding makeup ferrofluid to the process.

Recently, R. E. Rosensweig reported a number of features relating to magnetically stabilized fluidized magnetizable solids and provided a systematic interpretation of the phenomenon. *Science,* 204, pp. 57–60 (1979); *Ind. Eng. Chem. Fundam.,* 18, (3): 260–269 (1979); Rosensweig et al., *A.I.Ch.E. Symp. Ser.,* 77 (205), pp. 8–16 (1981); Lucchesi et al., *Proc. of the 10th World Petroleum Congress,* Bucharest, Romania, 1979, 4, Heyden and Sons, Philadelphia, Pa. (1979) and U.S. Pat.

Nos. 4,115,927 and 4,136,016, the entire disclosures of each being incorporated herein by reference. These publications noted the quiescent, fluid-like state of the magnetically stabilized fluidized bed (MSB), particularly a bed totally free of bubbles or pulsations when subjected to a uniform magnetic field applied colinear with the flow of the fluidizing fluid. Bed stabilization results in a non-bubbling fluid state having a wide range of operating velocities (denoted as superficial fluid velocities) between (a) a lower limit defined by the normal minimum fluidization superficial fluid velocity ($U_{mf}$) required to fluidize the bed in the absence of the applied magnetic field, i.e. magnetic effects, and (b) an upper limit defined by the superficial fluid velocity ($U_T$) required to cause time-varying fluctuations of pressure difference through the stabilized bed during continuous fluidization in the presence of the applied magnetic field. In U.S. Pat. No. 4,115,927, Rosensweig discloses that the stably fluidized solids resemble a liquid such that transport of the bed solids is facilitated while the pressure drop is limited to that of a fluidized bed. Also the backmixing normally associated with conventional fluidized bed processes is absent. While U.S. Pat. No. 4,115,927 also suggests the possibility of transporting solids from the containing vessel (see column 8 lines 58–59, and column 21, lines 17–24), none of the experiments involved continuous throughput of bed particles. Rosensweig also noted the beds fluid-like nature in that objects are readily immersed into the bed, and if light they float and if dense they sink (see column 7, lines 38–40). However, there is no suggestion that this phenomenon would be useful for the separation of mixtures.

SUMMARY OF THE INVENTION

The present invention pertains to a process for selectively separating a mixture comprising non-magnetic solids into at least two fractions according to the density (i.e. specific gravity) of said solids. More specifically, said mixture is separated into at least a heavier (i.e. more dense) solids fraction and a lighter (i.e. less dense) solids fraction by contact with a self-circulating fluidized bed of magnetizable particles that is stabilized by a magnetic means. The solids comprising the heavier solids fraction have a density greater than the apparent density of the bed. As such, the heavier solids fraction tends to move downward (i.e. sink) a sufficient distance in said bed to be conveyed to the lower portion of said bed by the circulatory motion of said bed. The solids comprising the lighter solids fraction have a density less than the apparant density of the bed and tend to rise or move (i.e. float) to or near the upper surface of the bed. The heavier and lighter solids fractions, along with a portion of the bed particles, are then removed from the bed as product streams. The self-circulation of the bed also promotes the separation. Conventional equipment such as sieves, screens or magnetic separators can be used to separate each solids fraction from the bed particles in said product stream.

With respect to the less dense solids, the apparent density of the bed refers to the density of the heaviest solids that will float. With respect to the more dense solids, the apparent density of the bed refers to the density of the lightest solids that will sink. Therefore, solids having a density greater than the apparent density of the bed will sink while solids having a density less than the apparent density of the bed will float. The apparent density of the bed may be different for the more dense and less dense fractions when the bed is operated in the stabilized regime. The apparent density of the bed for each fraction can be made to approach the same value by operations near $U_T$, by circulation of the bed or by both.

The particulate bed, which serves as the separating medium in the present invention, is fluidized by contact with an upward moving or ascending gaseous or liquid fluidizing fluid which enters the lower portion of the bed and exits from the upper surface thereof. The composition of the bed is judiciously selected such that a variety of non-magnetic solids having different densities can be separated and the bed can remain stabilized while undergoing self-circulation. Bed composition will vary depending on a number of process parameters including the density range of the mixture to be separated, the properties of the fluidizing fluid, and the like. The apparent density of the separating medium depends on the velocity of the fluidizing fluid and the physical properties of the particles therein.

The magnetic stabilizing means which serves to stabilize the bed should be of sufficient strength to suppress random particle backmixing within the bed but below that which would cause excessive particle to particle attractive forces. The magnetic stabilizing means permits operation over a broad range of superficial fluid velocities while maintaining bed stability. The magnetic means may be produced internally using permanently magnetized particles (such as are described in U.S. Pat. No. 4,261,101, the entire disclosure of which is incorporated herein by reference) or externally using an applied magnetic field. While the magnetic stabilizing means employed may be either internal or external (with external being preferred), the present invention will be described hereinafter with respect to the use of an externally applied magnetic field, most preferably a uniform applied magnetic field having a substantial component along the direction of an external force field (i.e., gravity).

DETAILED DESCRIPTION OF THE INVENTION

Figure 1:
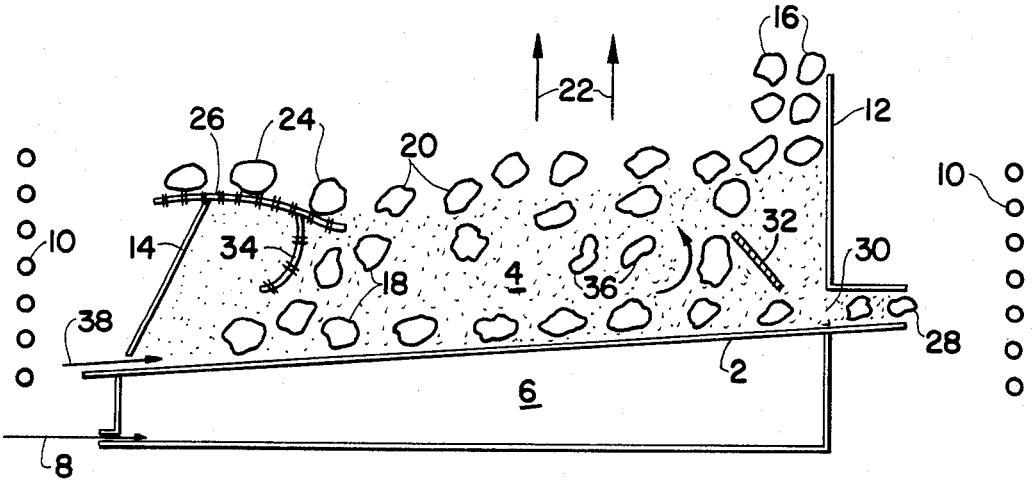
FIG. 1 illustrates a process for the separation of a mixture comprising non-magnetic solids in a self-circulating magnetically stabilized fluidized bed.

FIG. 1 illustrates one embodiment for separating a feed mixture comprising non-magnetic solids by density using a self-circulating magnetically stabilized fluidized bed. As shown therein, a rectangular shaped contacting vessel or zone is divided by a distribution means 2 into an upper section comprising a fluidized bed of magnetizable particles 4 (i.e., the separating medium) and a lower section or plenum 6 into which fluidizing fluid 8 is introduced. The vessel is surrounded by electromagnetic coils 10 that produce a magnetic field which serves to stabilize the bed, thereby reducing or eliminating the formation of bubbles and random backmixing within the bed. The separating medium is confined by boundary 12 and boundary 14, each of which could be the wall of the contacting vessel or a separate baffle which could be vertical or inclined toward the horizontal. One boundary 12 is located on the side of the vessel wherein the separating medium is moving in a substantially upward direction and the heavier particle product is withdrawn from said bed.

A feed mixture 16 comprising non-magnetic solids having differing densities is introduced into the separating medium 4 near boundary 12. The mixture can be introduced into the bed using any suitable means such as a hopper, conveyer belt and the like. If desired at least a portion of the mixture can be introduced into the bed at a more central location or at any other location in the bed. Initially, the heavier solids 18 (i.e., the more dense solids or solids fraction in the feed) will tend to move downward (i.e. sink) under the influence of gravity to a depth lower than the lighter (i.e. less dense) solids 20 (i.e., the less dense solids or less dense solids fraction in the feed mixture). Both lighter and heavier solids move with the particles in said bed which is moving in a transverse direction; i.e., a direction transverse to the flow of the fluidizing fluid 22 exiting the upper surface of the bed. The lightest (i.e. least dense) solids will float on the upper surface of the bed and be collected as a lighter solids product 24, for example, by means of screen 26 located near boundary 14. The heavier solids 18 (which in FIG. 1 need only sink a distance sufficient to pass under screen 26) remain in the bed and circulate with said bed—first in a downward or descending direction, near boundary 14, and then in a transverse direction towards boundary 12, a direction substantially parallel to distribution means 2. The heavier solids will tend to sink further due to gravity. Heavier solids that have "settled" sufficiently will be removed as a heavier solids product 28 from the contacting vessel or zone through an outlet 30 loated above distribution means 2 on or near the same side of the vessel as boundary 12.

In a preferred embodiment, a circulation enhancing baffle 32 alone or in combination with circulation enhancing screen 34 will be present in the contacting vessel. Baffle 32 (which is shown in FIG. 1 to be in close proximity to outlet 30) minimizes or eliminates accumulation of heavier solids 18 near boundary 12. Screen 34 (which is shown in FIG. 1 to be connected to screen 26 near boundary 14) minimizes or prevents accumulation of solids in the upper corner of the vessel where the lighter solids product is recovered. Both devices, therefore, enhance bed circulation and improve the efficiency of the separation.

Heavier solids 36 that have not "settled" sufficiently to be removed from the contacting vessel with the heavy solids product 28 will be transported upward by the circulation of the bed as they approach boundary 12. If baffle 32 is inserted into the separating medium, the circulation path of the "unsettled" heavier solids is reduced as shown by the arrow in FIG. 1. However, such solids will eventually sink to the bottom of the bed due to the downward component of gravity.

The lighter solids in the mixture which remain entrained in the bed and circulate therewith are subjected to a greater buoyant force than the heavier solids which tends to offset the downward forces of gravity. Thus the entrained lighter solids do not sink as deep in the bed as the heavier solids, which minimizes and virtually eliminates removal of the lighter solids from the bed through outlet 30. Rather, when the bed recirculates in an upward manner near boundary 12, the upward component of the solids velocity and the buoyant force of the bed will overcome the downward forces, such that the lighter solids will rise or move to or near the top surface of the bed and be collected by screen 26. The height of the separating medium should be sufficient to allow for recirculation such that the solids in the upper portion of the bed travelling in a transverse direction toward boundary 14 are not entrained with solids in the lower portion of the bed moving transversely toward outlet 30 and vice versa.

The lighter and heavier solids product streams 24 and 28, respectively, will normally exit the bed and contacting vessel admixed with a portion of the separating medium 4 and can subsequently be separated therefrom by conventional separation techniques such as sieving, magnetic separators, etc. The separating medium thus recovered can then be returned to the contacting vessel by conventional means such as conveyor belts, conveyor elevators, elevator screws, and the like to maintain inventory therein.

Figure 2:
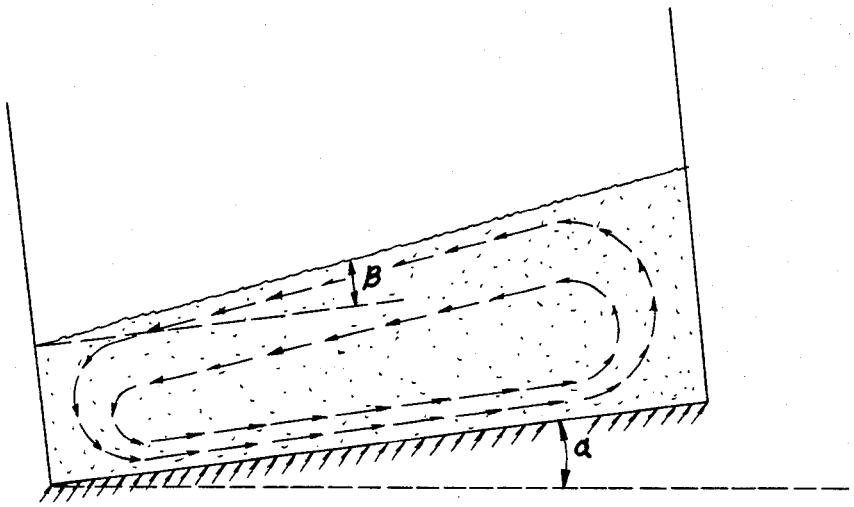
FIG. 2 illustrates the flow of solids and the angles associated therewith in a self-circulating magnetically stabilized fluidized bed.

The distribution means 2 which separates the fluidized bed 4 from the plenum 6 allows for the passage of fluidizing fluid from the plenum to the bed. The distribution means can be horizontal or inclined at an angle $\alpha$ to the horizontal (as shown in FIG. 2) to aid the circulation of the separating medium. The angle of inclination effects the particle paths within the bed and should be chosen to allow for the most efficient separation. As demonstrated in Example 1 below, when a distribution means is inclined with respect to the horizontal, the upper surface of the separating medium will be inclined at an angle $\beta$ with respect to the distribution means (see FIG. 2). Therefore the top surface of the bed is inclined at an angle $\alpha+\beta$ with respect to the horizontal, which must be considered when determining the angle of inclination of the distribution means, the height of the separating medium and the velocity of the fluidizing fluid. Increasing the velocity of the fluidizing fluid increases the circulation rate of the separating medium and increases $\beta$. Increasing $\alpha$ causes a decrease in $\beta$. Normally $\alpha$ will be less than 45 degrees and preferably less than 30 degrees. Typically, $\alpha$ will range from 0 to about 20 degrees or less.

The magnetically stabilized fluidized bed (i.e., the separating medium) utilized in the present invention has been described as a non-bubbling fluid state having a wide range of superficial fluid velocities between $U_{mf}$ and $U_T$. The bed may also be operated within a narrower range substantially near the locus of transition between the bubbling and stabilized regions of the bed as described for countercurrent beds in U.S. Pat. No. 4,247,987, the entire disclosure of which is incorporated herein by reference, and for transverse flowing beds in copending application Ser. No. 345,094 filed on the same date herewith, such that the fluidity ratio or $(U_T-U_{op})/(U_T-U_{mf})$ ranges between $-0.1$ and $+0.5$ where $U_{op}$ is the actual operating superficial fluid velocity. The fluidity of a magnetically stabilized bed continuously decreases from the fluidity at $U_T$ as the magnetic field is increased above, or the superficial fluid velocity is decreased below, the value at $U_T$. As the fluidity of the bed increases, the apparent density of the bed for the more dense solids fraction approaches the apparent density of the bed for the less dense solids fraction.

Magnetically stabilized fluidized beds have the appearance of expanded fixed beds with essentially no gross particles backmixing and essentially no fluid bypassing. The application of the magnetic field allows superficial fluid flow rates of 2, 5, 10 or more times the flow rate of the fluidized bed at incipient fluidization in the absence of the magnetic field, along with the substantial absence of gross particles backmixing and fluid bypassing such as bubbling in gas fluidized beds and roll-cell behavior in liquid fluidized beds. As the superficial fluid velocity is increased, the pressure drop through the bed is similar to that which would be expected from a normal fluidized bed not subjected to an applied magnetic field—the pressure drop increases to a value corresponding to the ratio of bed weight to cross sectional area at the minimum fluidization velocity, and then remains relatively constant as the fluid velocity is increased. This stably fluidized bed condition persists even as the bed particles are continuously added to and removed from the contacting vessel.

The magnetically stabilized fluidized bed (MSB) thus described combines in one system principal advantages of both fluidized bed and fixed bed systems as is summarized in Table 1 below.

TABLE 1

| | Fluid Bed | MSB | Fixed Bed |
|---|---|---|---|
| Small particle size with low $\Delta p$ | yes | yes | no |
| Absence of fluid bypassing | no | yes | yes |
| Continuous particle throughput | yes | yes | no |
| Avoids particle backmixing | no | yes | yes |
| Avoids entrainment from bed | no | yes | yes |

The bed may contain magnetic and non-magnetic particles. For example, non-magnetic particles may be used as admixtures or as composites with a ferromagnetic or ferrimagnetic substance. All ferromagnetic and ferrimagnetic substances, including, but not limited to, magnetic $Fe_3O_4$, $\gamma$-rion oxide ($Fe_2O_3$), ferrites of the form $MO.Fe_2O_3$, wherein M is a metal or mixture of metals such as Zn, Mn, Cu, etc.; ferromagnetic elements including iron, nickel, cobalt and gadolinium, alloys of ferromagnetic elements, etc., may be used as the magnetizable and fluidizable particles which are used in admixture or composited with the non-magnetic particles. Alternatively the nominally non-magnetic material may itself contain a ferromagnetic or ferrimagnetic substance in its chemical or physical makeup. In this case, the non-magnetic material exhibits magnetic properties. Therefore, no additional magnetic material need be admixed or composited with the non-magnetic material.

The weight fraction of magnetizable component when admixed or composited with a non-magnetic component will vary depending upon a variety of factors including the specific process conditions employed, the density of the solids to be separated, the magnetic properties of the bed particles, and the like. Typically, however, the fraction of magnetizable component in the bed will be at least 10 weight percent and, preferably, should range from about 25 to about 75 weight percent.

The bed particles (composites or admixtures) will typically have an average mean particle diameter ranging from about 50 to about 1500 microns. The particles may be of a single size of a mixture of several size ranges. The particles may be of any shape, e.g., spherical, irregular shaped or elongated.

The magnetizable particles used in the present invention must have the proper magnetizable properties. For economy, it is desirable that the bed particles achieve sufficient magnetization to stabilize the bed at a relatively small intensity of applied magnetic field. When ferromagnetic particles are placed in the magnetic field, the induced magnetization is a function of the magnetic material, the geometry of the ferromagnetic particle and the geometry of the bed, as is described in U.S. Pat. No. 4,247,987.

Conventional permanent magnets, electromagnets of both can be employed to provide the magnetic field. The electromagnets may be energized by alternating or direct current, the particular choice depending upon bed behavior, engineering design and economic analysis.

The invention is not limited by the shape or positioning of the magnet employed to produce an externally applied magnetic field. The magnet can be of any size, or shape and can be placed above or below the bed depending upon the particles used, the degree of stabilization required, and the like. The magnets can be placed within or outside the contacting vessel and may even be employed as an integral portion of the vessel structure. The process is not limited to any particular vessel or vessel material and it can be readily adapted for use in contacting vessels currently employed by industry. In a preferred embodiment of the present invention, a solenoid electromagnet is employed to surround the fluidized bed as this provides the most uniform magnetic field and consequently the best stability throughout the bed.

With proper selection of magnetic particles, the power requirement for the electromagnet field source in commercial plants will be modest. Magnet power dissipation generates heat that generally may be removed using natural convection air cooling. This may eliminate any need for liquid convection cooling and attendant requirements for coolant treatment and recirculation. The magnetic field source may be computer designed with high confidence to yield an applied magnetic field having a specified intensity and uniformity.

The strength of the magnetic field to be applied to the fluidized particles in the contacting zone will depend on the magnetization of the magnetizable particles and the degree of stabilization desired. Particles having relatively weak magnetic properties, e.g., some composites and alloys, will require the application of a stronger magnetic field than particles having strong magnetic properties, e.g., iron, to achieve similar stabilization effects. The size and shape of the particles will also have an effect on the strength of the magnetic field to be employed. The magnetization of the particles should not be sufficient to cause excessive particle to particle attractive forces and agglomeration which would tend to freeze or lock the particles in the bed and prevent separation of the solids. However, since the strength of the field produced by an electromagnet depends on the amount of current flowing through the coils of the electromagnet, an operator can readily adjust the field strength to achieve the desired degree of stabilization for the particular system employed. Specific methods of applying the magnetic field are also described in U.S. Pat. Nos. 3,440,731; 3,439,899; 4,115,927 and 4,143,469; British Pat. No. 1,148,513 and in the published literature, e.g., M. V. Filippov, Applied Magnetohydrodynamics, *Trudy Instituta Fizika Akad. Nauk.*, Latviiskoi SSR 12:215–236 (1960); Ivanov et al., *Kinet. Kavel*, 11 (5): 1214–1219 (1970) Ivanov et al., *Zhuranal Prikladnoi Khimii*, 45:248–252 (1972); and R. E. Rosensweig, *Science*, 204:57–60 (1979), the entire disclosures of each being incorporated herein by reference. The most preferred applied magnetic field will be a uniform magnetic field such as is described in U.S. Pat. No. 4,115,927. Typically, the applied magnetic field for an empty vessel will range from about 5 to about 1500 Oersteds, preferably from about 10 to about 1000 Oersteds.

The present invention can take place in any suitable vessel. The vessel may be equipped with internal supports, baffles, etc. Preferably there will be disposed in the lower portion of the vessel a distribution means which supports the bed and distributes the incoming gaseous or liquid fluidizing fluid. The distribution means should be manufactured such that the fluidizing fluid can pass easily from the plenum chamber into the separating medium while providing suitable pressure drop to the fluid to insure reasonable uniformity of fluid flow through said distribution means. This can be achieved using a porous plate of uniform porosity or a distribution grid having a multiplicity of holes through which the fluid passes. A packed bed of particles can also be used as a distribution means.

The self-circulating magnetically stabilized fluidized bed used in the present invention refers to a magnetically stabilized fluidized bed in which an essentially fixed or constant inventory of particles circulate in a closed loop within a contacting zone such that at least two different portions or layers of the bed (e.g., the upper and lower portions or layers) move in essentially opposite directions. For example, with respect to the bed shown in FIG. 1, the lower portion (or layer) of the bed flows in a direction essentially parallel to the distribution means 2 (and transverse to the direction of flow of the fluidizing fluid 22 exiting the bed). The bed particles then contact and are deflected by one boundary 12 of the contacting vessel (and/or a boundary within the vessel such as baffle 32) such that the upper portion (or layer) of the bed will flow in an essentially reverse or opposite transverse direction. The opposite flowing upper portion then contacts and is deflected by the opposite boundary 14 of the vessel (and/or a boundary within the contacting vessel such as screen 34) such that said upper portion becomes said lower portion. The two directional flow pattern of the self-circulating magnetically stabilized fluidized bed thus described is also shown by the arrows in FIG. 2.

As used herein, the expressions "essentially opposite (or reverse) directions" or "direction essentially opposite (or reverse)" refer to one portion (or layer) of the bed moving in a direction opposite to that of another layer (or portion) of said bed; i.e. layers that are essentially mirror images moving in opposite directions. The direction of one layer may or may not be parallel to the direction of the other layer. The expression "essentially fixed or constant inventory of particles" refers to maintaining essentially the same amount of particles in the separating medium by adding fresh particles to replace those removed with the product streams. Addition of fresh particles may be continuous or periodic to allow for variation in the particle inventory in the contacting vessel.

When a mixture comprising non-magnetic solids is introduced onto the top of the self-circulating magnetically stabilized fluidized bed shown in FIG. 1, the lighter solids 20 remain on or near the upper surface of the bed and are transported by the motion of said bed in one direction (toward the boundary 14 of the vessel from which the lighter solids product 24 is withdrawn) while the heavier solids 18 move downward in the bed and are transported by the motion of said bed in the essentially opposite direction (toward boundary 12 through which the heavier solids product 28 is withdrawn).

A variety of methods may be utilized to produce and maintain self-circulation of the separating medium. For example, as shown in FIG. 1, a gaseous or liquid fluid 38 (e.g., a portion of the fluidizing fluid) could be injected into the separating medium through a channel in the side of boundary 14 in a direction essentially transverse to the flow of the fluidizing fluid exiting the separating medium and in the direction of solids flow toward outlet 30. Using this configuration, the separating medium will be fluidized by passing fluidizing fluid upward through the distribution means.

Another and perhaps preferred embodiment is disclosed in copending application Ser. No. 607,408, a continuation of Ser. No. 345,096, now abandoned filed on the same date herewith. As disclosed therein, the distribution means orients at least a portion of the fluidizing fluid in the direction of bed particles flow; i.e., the fluid will enter the bed having a velocity component in the direction of desired bed particles flow and transverse to the flow of the fluidizing fluid exiting the bed. The orientation may be obtained using a distribution means containing holes or perforations (alone or in combination with nozzles or louvers) slanted in the direction of the desired particles flow in the lower portion (or layer) of the bed (see FIG. 2 for example). Normally, such slanted propulsion passages will be arranged in rows, offset and staggered to ensure a uniform distribution of fluidizing fluid in the bed. However, the actual spacing of the holes and their size and shape will vary depending upon the type of particles in the bed, the velocity of the fluidizing fluid and the like. If desired, the propulsion passages may extend into the bed (e.g., being placed on top of the grid or porous plate.).

In a preferred embodiment, multiple holes are drilled through the distributor grid at an angle transverse to the surface of the grid such that the fluid is introduced into the bed with a horizontal velocity component. This allows movement of the bed to be initiated and maintained by the fluidizing fluid.

The angle at which the propulsion passages are slanted can vary broadly depending on the particular particles and fluidizing fluid employed, the superficial velocity of the fluidizing fluid, the circulation rate of the separating medium, and the strength of the magnetic field. Normally, however, the propulsion passages will be slanted at an angle between about 5° and about 85° relative to the vertical in the direction of solids flow.

The fluidizing fluid which enters the bed will have horizontal and vertical components of velocity. However, while all of the fluid serves to fluidize the bed, only that portion of the fluid having a horizontal component of velocity contributes to inducing and maintaining the transverse flow of particles in said bed.

The operating conditions employed in the present invention may vary broadly depending upon the particular mixture to be separated, the fluidizing fluid velocity, etc. In general, the contact time of the feed mixture with the separating medium need only be that necessary to separate at portion of the mixture. Temperatures will range from ambient, or lower, to the Curie temperature of the magnetic component within the bed, and pressures will range from about 1 to about 10,000 psia. The superficial velocity of the fluidizing fluid will range between $U_{mf}$ and $U_T$ and will vary depending upon the type of particles in the bed, the strength of the magnetic field, the inclination of the distribution means, the geometry of the vessel and the like. In general, the velocity of the fluidizing fluid is selected to adjust the bulk specific gravity of the separating medium to that required to effect the separation at a specified flow rate of the feed mixture. Broadly, however, the superficial fluid velocity will range from about 0.0001 to about 5 m/sec. Liquid phase superficial fluid velocities will range typically from 0.0001 to about 0.1 m/sec. while gas phase superficial fluid velocities will range from about 0.001 to 5 m/sec. Similarly, the particle circulation rate can vary broadly depending upon the velocity of the fluidizing fluid, the geometry of the vessel, the particles being fluidized and other operating parameters. Generally, however, the circulation velocity (i.e. the linear velocity of the separating medium) will range from about 0.1 to about 200 cm/sec. At constant magnetic field, the circulation rate of the separating medium increases with increasing velocity of the fluidizing fluid.

The present invention is useful in separating virtually any non-magnetic material since the apparent density of the bed can be adjusted by varying the composition of the bed and the superficial velocity of the fluidizing fluid. This invention provides a particularly effective method for separating carbonaceous materials (e.g. coal) into several density fractions or for separating carbonaceous materials from other solids, such as rock, slate or limestone. The invention can also be used to benefication metal and mineral components from ore bodies, to separate shale from rubble, and the like. Often the separation can be effected without the use of cumbersome vibrating, shaking or pulsating equipment to overcome the interparticle forces. At other times, the use of such equipment may be advantageous.

The present invention has particular application to separating solids in a dry rather than a wet medium which requires washing and drying of the products. For example, it may be used to separate solids that are water sensitive; e.g. clay-like materials that form wet slimes, agricultural products whose quality would deteriorate if contacted with moisture or materials that would dissolve if handled in conventional wet separation processes.

The use of a magnetically stabilized fluidized bed results in a stable separating medium that will not be subject to internal random turbulence and random particle backmixing. Thus, a high resolution separation of a mixture of non-magnetic solids having different densities can be obtained. In addition, self-circulation of the separating medium reduces or eliminates forces which can immobilize the solids to be separated, thus improving recovery thereof. Therefore, self-circulation of the separating medium also reduces the size of the contacting vessel relative to that required for stationary beds. An additional advantage is that the particles can be added to and removed from the bed, and that the particles in the bed will not backmix but will move in a plug flow manner from the point of introduction to the point of withdrawal.

The present invention will be further understood by reference to the following examples which are not intended to restrict the scope of the claims appended hereto.

EXAMPLE 1

Figure 3A:
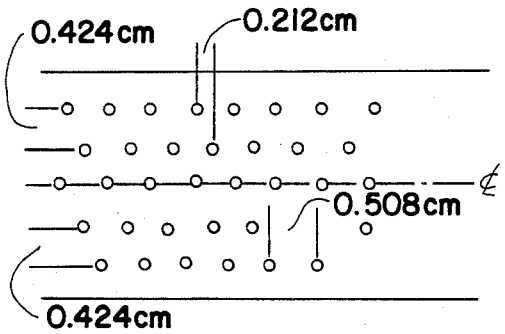
FIGS. 3*a* and 3*b* illustrate the top and side view, respectively, of the distributor grid used in an experimental apparatus.
Figure 3B:
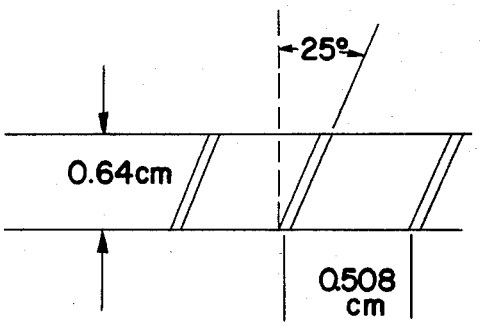

A separating medium comprising composite particles of 70 wt.% stainless steel and 30 wt.% alumina were placed in a MSB unit similar to that shown in FIG. 1. The unit measured 2.54 cm wide and 32.5 cm long. The particles had an average particle size of 1300 microns and a density of 2.9 g/cc. The bed was fluidized by air passing through a 0.64 cm thick aluminum distributor grid perforated with holes slanted 25 degrees to the vertical in the direction of desired solids flow. The holes were arranged in rows 0.424 cm apart with one-half (i.e., 0.212 cm) spacing offset (brick-layer fashion). The centerline of the holes in each row was spaced 0.508 cm from the centerline of adjacent holes. Top and side views of the grid are shown in FIGS. 3*a* and 3*b*, respectively. As shown in FIG. 2, the unit was tilted on an angle $\alpha$ with respect to the horizontal and in a direction opposite to the gradient in bed height (i.e. in the direction of particle flow along the distribution means or grid).

The entire unit was placed in a vertical magnetic field supplied by two solenoidal electromagnets connected in parallel, placed one above the other 15.5 cm apart, each made of 700 turns of #14 enameled copper wire. The magnets were elliptical in design with inside dimensions of 22 cm by 94.5 cm.

Passage of the air through the slanted holes caused the particles at the lower portion of the bed, in the vicinity of the grid, to move in the direction that the holes were drilled. Particles at the top surface of the bed were observed to move in a direction essentially opposite to the particles flow near the grid. Thus, a self-circulating bed similar to that shown in FIG. 2 was established.

In addition to the distributor grid being tilted with respect to the horizontal, the top surface of the bed was inclined at an angle $\beta$ with respect to the grid. Thus, the top surface of the bed was inclined at a total of angle $\alpha+\beta$ with respect to the horizontal.

Several runs were made at various conditions using the stainless steel/alumina composite and $-20+30$ U.S. sieve steel spheres. The results of this experiment are shown below in Table 2.

TABLE 2

| Separating Medium | Gas Superficial Velocity (cm/sec) | Particles Transverse Flow Velocity at Top of Bed (cm/sec) | Average Bed Height (cm) | Applied Magnetic Field (Oersted) | $\alpha$ | $\beta$ |
|---|---|---|---|---|---|---|
| SS/Alumina Composite | 99.2 | 3.5 | 4.2 | 44 | 1.9° | 1.8° |
| | 109.1 | 6.0 | 5.2 | 74 | 1.9° | 3.3° |
| | 134.1 | 12.7 | 4.8 | 148 | 1.9° | 6.0° |
| | 121.0 | 6.8 | 5.9 | 103 | 1.9° | 3.0° |
| | 134.1 | 9.7 | 6.2 | 133 | 1.9° | 3.6° |
| Steel Spheres | 121.5 | 3.1 | 3.2 | 30 | 1.9° | 1.5° |
| | 121.5 | 2.6 | 3.2 | 30 | 4.3° | 0.3° |

This experiment shows that a continuous self-circulating bed would be established and maintained when the bed is stabilized by a magnetic means. In addition, the runs utilizing steel spheres as the separating medium show that at constant superficial gas velocity and applied magnetic field, $\beta$ decreases with increasing $\alpha$. Also, increasing superficial gas velocity increases the particle circulation rate and $\beta$.

EXAMPLE 2

Five runs involving the separation of a mixture of coal and limestone were performed in a rectangular shaped vessel similar to that shown in FIG. 1. The vessel measured 2.54 cm wide, 70 cm long, 12.7 high and was tilted at an angle of 3.7 degrees with respect to the horizontal. As shown in FIG. 1, boundary 14 and boundary 12 were placed so as to restrict the effective length of the bed to no more than 30 cm. Boundary 12 measured 3 cm. and was placed such that the vertical opening outlet 30 measured 2.5 cm. In runs 1–3, the boundary 14 was tilted at an angle of 60 degrees with respect to the bottom of the vessel. In runs 4 and 5, the boundary 14 was tilted at an angle of 64 degrees with respect to the bottom of the vessel and a baffle 32 was placed near boundary 12 at an angle of 38 degrees and a distance of 2.5 cm from the bottom of the vessel. A 5 mesh screen 26 was used in each run, with a vertical circulation enhancing screen 34 also being used in runs 4 and 5. In runs 1–3, screen 26 was horizontal while in runs 4 and 5 a portion of the screen extended into the bed to facilitate removal of the lighter solids product.

The separating medium comprised −14+20 U.S. sieve composite particles of 70 wt.% stainless steel and 30 wt.% alumina with a density of 2.71 g/cm$^3$.

The particles were fluidized by air passing through a distributor grid having holes slanted at an angle of 25 degrees to the vertical. The superficial velocity of the air was 109 cm/second or about 2.3 times the minimum fluidization velocity of the bed particles. Passage of the fluidizing fluid through the slanted holes oriented the fluid with a horizontal velocity component which then transferred momentum to the bed particles causing movement of the lower portion of the bed along the grid in the direction of the horizontal velocity component. The separating medium had an average height of 5.1 cm and was stabilized by an applied magnetic field of 75.4 Oersted.

In each run, a mixture of solids ranging from 0.4 cm to 1.27 cm in size and containing 50 wt.% coal (density 1.39 g/cc) and 50 wt.% limestone (density 2.71 g/cc) was added to the self-circulating bed at a rate of about 40 grams per minute for a total of about 8 minutes. The bed circulated for 4 minutes following solids addition during which lighter solids and heavier solids product streams continued to be collected. The yield and purity of both solids product streams were measured for each run and are shown in Table 3.

horizontal rather than sloped downward in the direction of the separating medium as in runs 4 and 5. As such, a larger quantity of lighter solids was either entrained in the separating medium or removed from the bed with the heavier solids through outlet 30 or both. Baffle 32 also facilitated recovery of the coal in runs 4 and 5.

What is claimed is:

1. A process for separating a mixture comprising non-magnetizable solids according to the density of said solids which comprises:

(a) contacting said mixture with a separating medium comprising a magnetically stabilized fluidized bed containing an essentially fixed inventory of magnetizable particles circulating within a contacting zone such that the upper portion of said separating medium moves in a direction essentially opposite to that of the lower portion of said separating medium, both portions moving transverse to the flow direction of the fluidizing fluid leaving the upper surface of said separating medium, the circulation of said separating medium being initiated or maintained by the introduction of a fluid in a direction essentially transverse to the flow of the fluidizing fluid leaving the upper portion of the separating medium, said separating medium being stabilized by a magnetic means having a strength sufficient to suppress particle backmixing therein, (b) separating said mixture into a less dense fraction comprising solids having a density less than the apparent density of the separating medium and a more dense fraction comprising solids having a density greater than the apparent density of the separating medium, (c) conveying at least a portion of the less dense solids fraction with the upper portion of said separating medium and at least a portion of the more dense solids fraction with the lower portion of said separating medium by the circulatory motion of said separating medium, and (d) withdrawing at least a portion of the less dense solids fraction from the upper surface of the separating medium and at least a portion of the more dense solids fraction from the lower portion of said separating medium.

2. The process of claim 1 wherein said separating medium comprises composites of magnetizable particles and non-magnetizable particles.

3. The process of claim 1 wherein said separating medium is an admixture of magnetizable particles and non-magnetizable particles.

4. The process of claim 1 wherein the magnetic means is an externally applied magnetic field.

TABLE 3

| | Feed Mixture, gms | | Lighter Product, gms | | Heavier Product, gms | | Remaining in Separating Medium, gms | | Lime in | Coal in |
|---|---|---|---|---|---|---|---|---|---|---|
| Runs | Coal | Limestone | Coal | Limestone | Coal | Limestone | Coal | Limestone | Lime Rich | Coal Rich |
| 1 | 158.7 | 170.5 | 85.6 | 3.5 | 37.0 | 146.5 | 29.2 | 10.0 | 86% | 54% |
| 2 | 151.6 | 160.7 | 102.0 | 0.5 | 19.4 | 146.5 | 26.5 | 20.4 | 91% | 67% |
| 3 | 148.0 | 167.8 | 101.4 | 0.7 | 14.0 | 156.0 | 29.2 | 4.1 | 93% | 69% |
| 4 | 144.2 | 150.0 | 140.5 | 0.85 | 2.95 | 148.6 | 0.7 | 0.0 | 99.1% | 97.4% |
| 5 | 150.0 | 150.0 | 144.9 | 0.25 | 4.5 | 149.5 | 0.1 | 0.0 | 96.6% | 99.7% |

The data in Table 3 show that a mixture of coal and limestone can be separated effectively in a self-circulating magnetically stabilized fluidized bed. The separation was less effective in runs 1–3 because screen 26 was

5. The process of claim 4 wherein said magnetic field is applied in a direction colinear with the flow of the fluidizing fluid leaving the upper surface of the separating medium.

6. The process of claim 1 wherein said magnetic means is obtained using permanently magnetized particles as the separating medium.

7. The process of claim 1 wherein the entering fluidizing fluid passes through a distribution means located in the lower portion of said contacting zone.

8. The process of claim 7 wherein said distribution means is inclined with respect to the horizontal.

9. The process of claim 7 or 8 wherein the transverse motion of the lower portion of the separating medium is initiated and maintained by passing the entering fluidizing fluid through said distribution means.

10. The process of claim 1 or 7 wherein said mixture contains carbonaceous particles.

11. The process of claim 1, 2 , 3, 4 or 6 wherein said fluidizing fluid is gaseous.

12. The process of claim 1, 2, 3, 4, or 6 wherein said fluidizing fluid is liquid.

* * * * *